US009153916B2

(12) United States Patent
Schloo et al.

(10) Patent No.: US 9,153,916 B2
(45) Date of Patent: Oct. 6, 2015

(54) ELECTRICAL MODULAR TERMINAL AND MODULAR TERMINAL BLOCK

(75) Inventors: Torsten Schloo, Detmold (DE); Franck Stieler, Kalletal (DE); Jens Lange, Marienmünster (DE); Carsten Pollmann, Steinheim (DE); Dennis Habirov, Bielefeld (DE); Christian Kloppenburg, Büren Wewelsburg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 21 days.

(21) Appl. No.: 14/344,714

(22) PCT Filed: Sep. 13, 2012

(86) PCT No.: PCT/EP2012/003833

§ 371 (c)(1),
(2), (4) Date: Mar. 13, 2014

(87) PCT Pub. No.: WO2013/037490

PCT Pub. Date: Mar. 21, 2013

(65) Prior Publication Data

US 2014/0329397 A1 Nov. 6, 2014

(30) Foreign Application Priority Data

Sep. 15, 2011 (DE) ..... 10 2011 113 333

(51) Int. Cl.
*H01R 29/00* (2006.01)
*H01R 13/703* (2006.01)
(Continued)

(52) U.S. Cl.
CPC ..... *H01R 13/703* (2013.01); *H01R 9/2491* (2013.01); *H01R 9/2633* (2013.01); *H01R 13/7033* (2013.01); *H01R 31/08* (2013.01); *H01R 2201/20* (2013.01)

(58) Field of Classification Search
CPC ..... H01R 2103/00; H01R 24/58
USPC ..... 439/188, 49, 712, 715; 200/51.1
See application file for complete search history.

(56) References Cited

U.S. PATENT DOCUMENTS 3,289,146 A * 11/1966 Tuchel ..... 439/743
5,658,172 A * 8/1997 Schmidt et al. ..... 439/716

(Continued)

FOREIGN PATENT DOCUMENTS

DE 1 197 152 B 7/1965
DE 196 08 517 C1 8/1997

(Continued)

*Primary Examiner* — Abdullah Riyami
*Assistant Examiner* — Thang Nguyen
(74) *Attorney, Agent, or Firm* — Roberts Mlotkowski Safran & Cole, P.C.; David S. Safran

(57) ABSTRACT

An electrical series terminal having a terminal housing, conductor connector elements, and current bars, the current bars each having a connector section and a first contact section, the connector sections being assigned to a conductor connector element and the first contact sections together forming a resilient contact region to receive the plug of the test or power plug. A switchable transverse bridge is producible by each current bar having a second contact section, two further current bar pieces being arranged in the terminal housing, and a recess being formed in a current bar piece for insertion of a branch of a jumper. A current bar piece is assigned to a respective current bar so that the second contact section of a current bar is connected to the assigned current bar piece when no plug is inserted and is spaced from the assigned current bar piece when a plug is inserted.

11 Claims, 7 Drawing Sheets

(51) Int. Cl.

| | |
|---|---|
| ***H01R 9/24*** | (2006.01) |
| ***H01R 9/26*** | (2006.01) |
| *H01R 31/08* | (2006.01) |

(56) References Cited

U.S. PATENT DOCUMENTS

| | | | | |
|---|---|---|---|---|
| 7,271,357 | B2 * | 9/2007 | Ostmeier | 200/51.09 |
| 7,666,037 | B2 * | 2/2010 | Diessel | 439/857 |
| 8,007,312 | B2 * | 8/2011 | Bower et al. | 439/540.1 |
| 8,461,856 | B2 * | 6/2013 | Ostmeier | 324/756.05 |

FOREIGN PATENT DOCUMENTS

| | | | |
|---|---|---|---|
| DE | 10 2005 025 108 | B3 | 7/2006 |
| DE | 10 2008 014 177 | A1 | 9/2009 |
| FR | 2 165 070 | A6 | 8/1973 |

* cited by examiner

ELECTRICAL MODULAR TERMINAL AND MODULAR TERMINAL BLOCK

BACKGROUND OF THE INVENTION

1. Field of the Invention

The invention relates to an electrical modular terminal, especially for connection of a current transformer, with a terminal housing, with at least two conductor connector elements which are located in the latter, and with at least two current bars, the current bars each having a connector section and a first contact section, the connector sections being assigned to a respective conductor connector element and the first contact sections together forming an elastic contact zone for accommodating the plug of a test plug or power plug, the first contact sections being spaced apart from one another and only with the plug inserted being connected to one another in an electrically conductive manner via the plug. In addition, the invention relates to a modular terminal block formed of at least two electrical modular terminals which are located next to one another and of at least one plug-in jumper which has at least two legs.

2. Description of Related Art

Electrical modular terminals have been known for decades and are used in the millions in wiring of electrical systems and devices. The terminals are often locked onto mounting rails which for their part can be located in a plurality in a switchgear cabinet. In addition, the modular terminals can, however, also be attached alone or in general severally as a modular terminal block in a wall opening, especially in an opening in a switchgear cabinet wall. This has the advantage that one side of the terminals, the operator side, is accessible from outside the switchgear cabinet without the switchgear cabinet having to be opened and only the other side of the terminal, the connecting side, is accessible only when the switchgear cabinet has been opened.

Conductor connector elements in modular terminals are predominantly screw terminals or tension spring terminals. The terminal principle for tension spring terminals is similar to that of the screw technology. While in a screw terminal a tension sleeve draws the conductor against the current bar by the actuation of the terminal screw, in the tension spring terminal this task is assumed by the tension spring. In addition however insulation piercing connecting terminals or leg spring terminals can also be used.

Electrical terminals are generally connecting terminals so that they have at least two conductor connector elements which are electrically connected to one another via an electrically conductive connecting bar, the current bar. In addition to this basic type of modular terminal which is often also called a feed-through terminal, there are a plurality of different modular terminal types which are specially matched to the respective applications (compare, Phoenix Contact Catalog Modular Terminals CLIPLINE 2011, pages 2-11). Examples are protective conductor terminals, isolating blade terminals and installation terminals.

In switching, measuring and control technology feed-through terminals with a disconnect possibility are the standard. The disconnection possibility which is implemented in the electrical modular terminal, i.e., the disconnect provided in the current bar makes it possible to insert different plugs with different function into the terminal housing of the modular terminal which then make contact with the current bar at the disconnect. In addition to simple disconnect plugs or through connectors, plugs can also be especially test plugs which can have special components and which enable testing of proper operation of the circuit which is connected to the modular terminal. Since the electrical modular terminals are generally made disk-shaped, they are generally mated to several other electrical modular terminals into a modular terminal block. A number of test plugs which corresponds to the number of modular terminals can then be plugged into such a modular terminal block.

German Patent 10 2005 025 108 B3 discloses a device for testing of a protective, measuring or counting apparatus, for example, a protective line relay of a high voltage or medium voltage system, which has a pole strip which can be connected to the electrical apparatus with several successively arranged pole openings and one plug block with a number of pole tongues which corresponds to the number of pole openings. An individual pole strip module of the pole strip consists of a housing in which there are two insert contacts for connecting the lines and spring-loaded contact clips which are connected to the insert contacts. The two contact clips can make contact with the pole tongue of a plug, the pole tongue of the plug having two pole segments which are separated from one another by an insulating segment. The insulating segment together with the corresponding pole opening in the pole strip module forms a polarization which ensures that only one plug with a certain pole tongue can be inserted into a certain pole opening of a pole strip.

In the state of the plug or the pole tongue not inserted into the pole strip, the two contact clips make contact with one another so that the two insert contacts are electrically connected to one another in an electrically conductive manner and a current can flow via a connected pole strip. If the plug with its pole tongue has been pushed completely into the pole opening, the two contact clips are electrically isolated from one another and the current flow is routed via the plug so that a test process can be carried out.

German Patent Application DE 10 2006 052 894 A1 and corresponding U.S. Pat. No. 7,666,037 B2 discloses a modular terminal, a test plug and a test terminal block consisting of a plurality of modular terminals located next to one another and a corresponding number of test plugs, the individual modular terminals and the individual test plugs being similar in basic principle to the pole strip modules and pole plugs known from DE 10 2005 025 108 B3.

In order to ensure reliable and defined contact states when the test plug is plugged into the test opening, in this known electrical modular terminal, the current bars are made such that they form two contact zones which are located in succession in the insertion direction of the contact plug of a test plug. Forming a defined second contact zone which is located in the insertion direction of the contact plug upstream of the first contact zone ensures that when the contact plug is inserted first a reliable electrical connection between the contact plug and the two current bars takes place before the first contact zone is opened as the contact plug continues to be inserted, as a result of which the two current bars are then electrically isolated from one another.

It is common to the above described known modular terminals or test terminal blocks that the two current bars make contact with one another so that the conductor connector elements are connected to one another in an electrically conductive manner if a plug is not plugged into the modular terminal. Conversely, if a plug is (completely) plugged into the modular terminal, the contact zone is interrupted so that the conductor connector elements are also electrically isolated from one another.

In addition to these modular terminals or test terminal blocks, test isolation blocks are also known, especially those from the Russian company Cheaz in which the elastic contact sections of the current bars which together form an elastic contact zone are spaced apart from one another and are only connected to one another in an electrically conductive manner when a plug of a power plug or test plug is plugged into the contact zone. The electrically conductive connection between the contact sections or between the current bars takes place via the inserted plug which for this purpose has two interconnected contact sections which make contact with the contact sections of the current bars when the plug has been plugged in.

In these test isolation blocks which are common especially in Eastern Europe and Russia, the conductor connector elements which are assigned to one another are only connected to one another in an electrically conductive manner when a corresponding power plug is plugged into the modular terminal or into the terminal block. These modular terminals or terminal blocks are used especially for connection of current transformers. One important functional feature consists in that the power transformers are shorted as soon as the test plug or the power plug is pulled out of the modular terminal or the terminal block.

For this purpose, in the known test isolation blocks, there are jumper plugs via which at least two adjacent current bars are connected to one another in an electrically conductive manner so that the assigned conductor connector elements are short-circuited. In this way, then the current transformers which are connected to the conductor connector elements are also short-circuited. The jumper plugs are located between the contact sections of the current bars, which sections are opposite one another, such that they make contact with one contact section of a current bar when a plug has not been plugged in. If a test plug or power plug is plugged into the electrical modular terminal or into a test terminal block, the contact sections of two current bars, which sections are opposite one another, are forced somewhat apart. This leads first of all to the contact sections being connected to one another via the electrically conductive plug. Moreover, the insertion of the plug into the contact zone however also leads to the connection between the contact section and one leg of the jumper plug being interrupted since the elastic contact section is forced away from the rigidly arranged jumper plugs by inserting the plug.

In the test terminal blocks which are known from the prior art, an electrically conductive connection between adjacent contact sections or current bars is thus ensured by the jumper plugs. This transverse bridging is automatically interrupted when a test plug or power plug is plugged in, at the same time the contact sections which are assigned to one another being electrically connected to one another in an electrically conductive manner via the plug.

Although these test isolation blocks have proven themselves in practice for decades, they also have some disadvantages. The disadvantages consist especially in that the structure and the mounting of the test isolation blocks are relatively involved. In particular, the mounting of the jumper plugs on the bottom of the housing of the test terminal block is relatively laborious, since the elastic contact zones must be deflected against their spring force for this purpose. At the same time, the jumper plugs must be fastened with a screw to the bottom of the housing, to ensure that the contact sections which have made contact with the jumper plug are deflected equally so far that equally good contact between the jumper plug and the contact sections is also ensured later. Finally there is the risk that the elastic current bars which are held only by a threaded rod will twist in the mounting of the jumper plugs; this can likewise have an adverse effect on the electrical contact between the contact section and the jumper plug.

SUMMARY OF THE INVENTION

Therefore, the object of this invention is to provide an electrical modular terminal and a modular terminal block formed of a plurality of modular terminals of the initially described type in which the above described problems are avoided for the most part so that switchable cross bridging to an adjacent electrical modular terminal can be accomplished.

This object is achieved in an electrical modular terminal in that each of the current bars has a second contact section, and that there are two other current bar pieces in the terminal housing, in at least one current bar piece at least one recess being formed for inserting one leg of a plug-in jumper. In accordance with the invention, each current bar piece is assigned to a respective current bar such that the second contact section of a current bar is connected in an electrically conductive manner to the assigned current bar piece when the plug is not plugged in, while the second contact section of a current bar is spaced apart from the assigned current bar piece when the plug has been plugged in.

Instead of using the jumper plugs which are used in the prior art, in the electrical modular terminal, in accordance with the invention, transverse bridging to an adjacent modular terminal can take place by a leg of a plug-in jumper being inserted into the recess provided for this purpose in the respective current bar pieces of two modular terminals. The electrical transverse connection between two conductor connector elements of two modular terminals takes place via the respective current bars, the current bar pieces and the inserted plug-in jumper. The current bars of the modular terminal are connected in an electrically conductive manner on the one hand with their connector section to the conductor connector element and on the other with their second contact section to the respective current bar piece. The electrical connection between the second contact section of a current bar and the assigned current bar piece is based on the spring force of the current bar which presses the second contact section against the current bar piece.

Of course, transverse bridging of more than two adjacent modular terminals can also take place in this way, for which the plug-in jumper used need have only a corresponding number of legs. Thus, a modular terminal block comprised of a plurality of modular terminals in accordance with the invention has the further advantage that the modular terminal block has a modular construction so that the number of modular terminals and thus the pole number of the modular terminal block can be freely chosen. In contrast, the test isolating blocks which are known from practice are only available in given sizes—4-pin or 6-pin.

If the plug of a test plug or power plug is plugged into the elastic contact zone between the first contact sections of the current bars, this first of all leads to the contact sections and thus also the current bars being connected to one another in an electrically conductive manner via a plug. In doing so, not only are the first contact sections of the current bars forced farther apart, but the second contact section of the current bar is also moved away from the assigned current bar piece so that the second contact section is spaced apart from the current bar piece and thus the electrically conductive connection is interrupted.

According to an advantageous configuration of the modular terminal in accordance with the invention, the current bars also each have one recess for insertion of a plug, especially of a test plug or one leg of a plug-in jumper. This yields the possibility of plugging the corresponding plugs into the current bar pieces and also in the current bars, and then transverse bridging of adjacent modular terminals can also be accomplished by the legs of a plug-in jumper being inserted into the recesses in the assigned current bars of adjacent modular terminals.

The two current bars can be implemented by punching-out and subsequent bending of a respective elongated metal strip. However, preferably, it is provided that the two current bars each are formed of two individual elongated metal strips which are connected to one another in an electrically conductive manner, especially are welded, soldered or riveted to one another. The connector section of a current bar is formed by the first metal strip, while the first contact section and the second contact section are formed by the second metal strip. On the one hand, this simplifies the production of the current bar, and on the other hand, it makes it possible to use, for the connector section and the two contact sections of different materials or different cross sections, each of which can be chosen according to the respectively required stiffness or spring property. The first metal strip which forms the connector section can be made relatively rigid while the second metal strip itself is made as a contact spring so that both good contact-making between the first contact section and an inserted plug or also between the second contact section and the assigned current bar piece is ensured.

In the initially described modular terminal block composed of at least two electrical modular terminals which are located next to one another and at least one plug-in jumper which has at least two legs, the object of the invention is achieved in that a leg of a respective plug-in jumper is plugged into at least one current bar piece of the first modular terminal and in the corresponding current bar piece of the second modular terminal. In this way, then, two conductor connector elements of the electrical modular terminals which are located next to one another are connected to one another in an electrically conductive manner when a plug of a power plug has not been inserted in the two modular terminals.

As has been stated above in conjunction with the modular terminal In accordance with the invention, the transverse bridging which can be switched via the power plug, with the plug not plugged in, takes place via the current bar, the current bar piece and the plug-in jumper which has been plugged into the two adjacent current bar pieces. If the plug of a power plug is plugged into the modular terminal block, as described above this leads to the second contact section of a current bar being moved away from the pertinent current bar piece, as a result of which the transverse bridging is interrupted.

The electrical modular terminals which together form the modular terminal block are each made disc-shaped. So that several modular terminals together can form a modular terminal block, the individual modular terminals are mechanically connected to one another, for which the modular terminals are locked together via corresponding catch elements which are made in the terminal housing. The catch elements consist preferably of latch pins which are located on one side of the terminal housing and corresponding latch recesses which are made in the other side of the terminal housing.

In particular, there is now a host of possibilities for embodying and developing the electrical modular terminal and the modular terminal block in accordance with the invention. In this regard reference is made to the following detailed description of preferred exemplary embodiments in conjunction with the accompanying drawings.

BRIEF DESCRIPTION OF THE DRAWINGS

FIG. 2 shows the modular terminal as shown in FIG. 1 with the power plug plugged in.

DETAILED DESCRIPTION OF THE INVENTION

Figure 1:
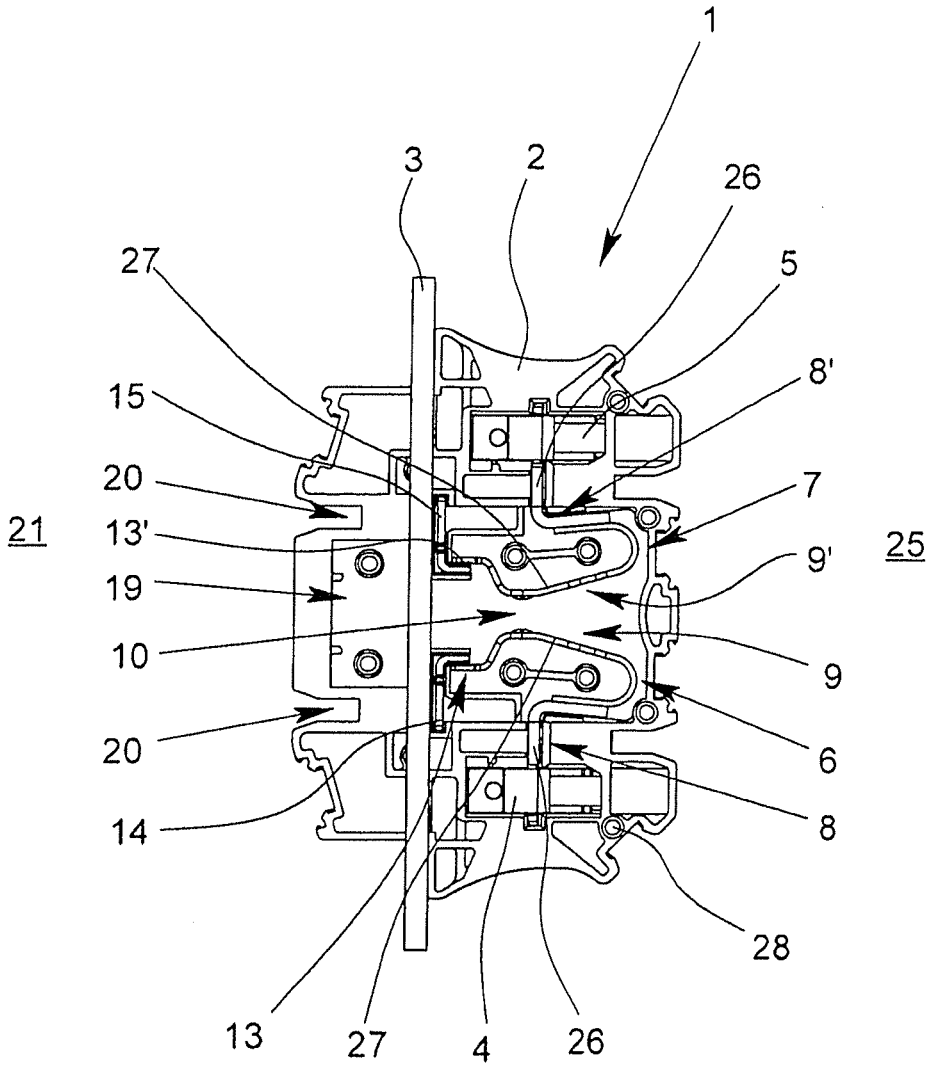
FIG. 1 shows a modular terminal in accordance with the invention, from the side.
Figure 2:
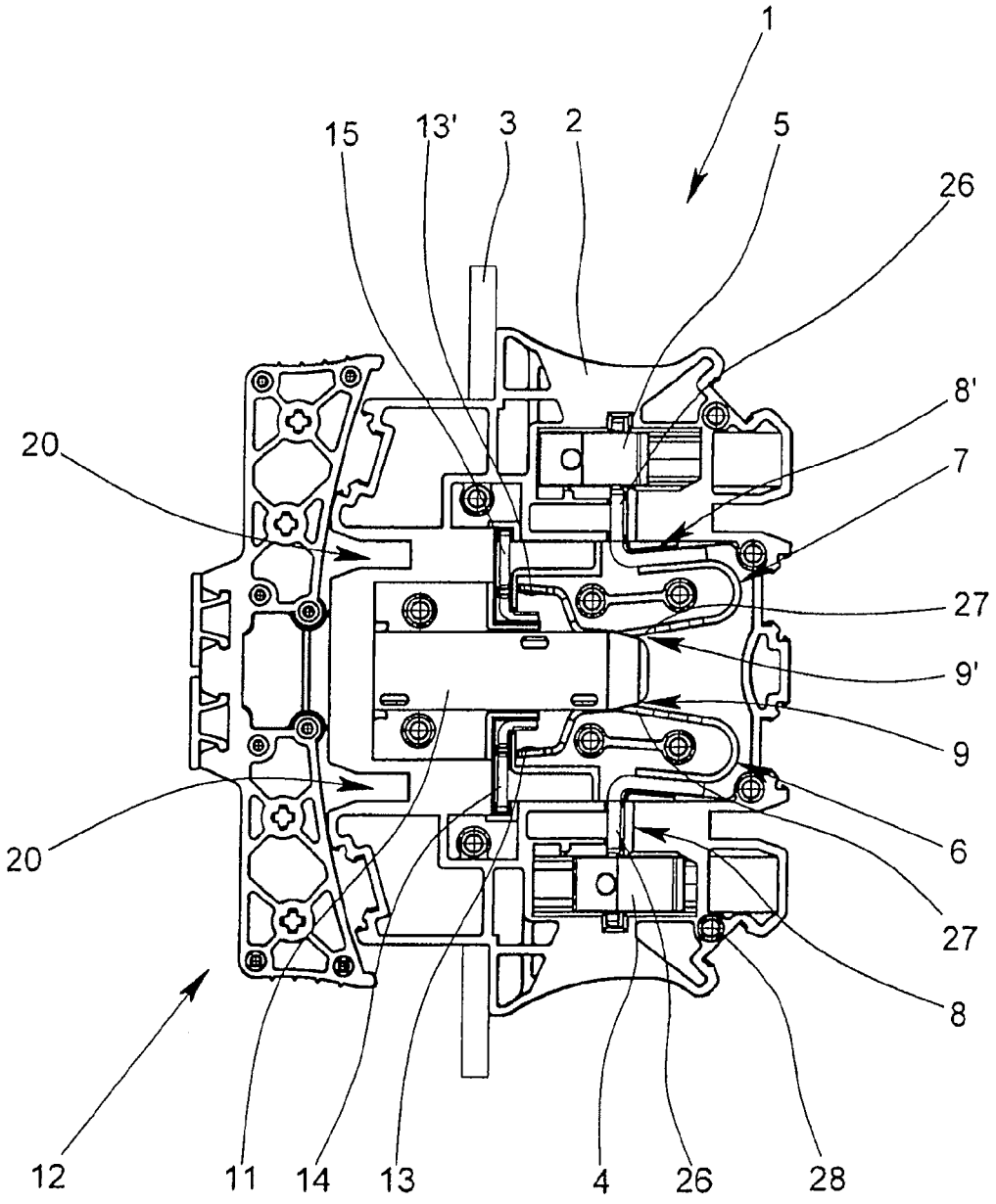

FIGS. 1 & 2 each shown one electrical modular terminal 1, while FIGS. 3 to 8 each show a modular terminal block comprise of several modular terminals 1. FIG. 9 shows two enlargements of an extract of the modular terminal 1 in accordance with the invention in two different connection situations.

The electrical modular terminal 1 has a terminal housing 2 which, in the illustrated embodiments, is fastened in one opening of a wall 3, the wall 3 being especially a switchgear cabinet wall or switchgear cabinet door. Within the terminal housing 2, there are two conductor connector elements 4, 5, the illustrated conductor connector elements 4, 5 being screw terminals. However, other types of connector elements can also be effectively used as conductor connector elements, for example, tension spring terminals, insulation piercing connecting terminals, or leg spring terminals.

In addition to the conductor connector elements 4, 5, in the terminal housing 2, there are two identically made current bars 6, 7 which are arranged symmetrically to one another. The current bars 6, 7 on their one end each have a connector section 8, 8' which is assigned to one of the two conductor connector elements 4, 5 at a time, i.e., is inserted into the screw terminal. Moreover, the two current bars 6, 7 each have a first contact section 9, 9', the two contact sections 9, 9' together forming an elastic contact zone 10 for accommodating the plug 11 of a power plug 12. Additionally, the two current bars 6, 7 each have a second contact section 13, 13' on their second end, the two second contact sections 13, 13' being used for making contact with another shorter current bar piece 14, 15.

The second contact sections 13, 13' adjoin the current bar pieces 14, 15 only as a result of the spring force of the current bars 6, 7, the contact surfaces which correspond to one another and the spring force being sufficient to ensure good current transfer between the current bars 6, 7 and the current bar pieces 14, 15. The solely elastic contact of the second contact sections 13, 13' with the current bar pieces 14, 15 makes it possible for this conductive connection to be able to be easily broken. While the second contact sections 13, 13' adjoin the current bar pieces 14, 15 (FIG. 1) when a plug 11 of a power plug 12 is not plugged into the modular terminal 1, the second contact sections 13, 13' are spaced apart from the current bar pieces 14, 15 when a plug 11 has been plugged into the elastic contact zone 10 between the current bars 6, 7 (FIG. 2).

As is apparent from FIGS. 1 and 2, the first contact sections 9, 9' are each located between the connector section 8, 8' and the second contact section 13, 13' of a current bar 6, 7. On one end region of a current bar 6, 7, there is thus a respective connection section 8, 8' which is assigned to the conductor connector element 4, 5, while the other end region of the current bar 6, 7 is made as a second contact section 13, 13' which interacts with the assigned current bar piece 14, 15. This results in a relatively great deflection of the second contact sections 13, 13' of the current bars 6, 7 when a plug 11 is plugged in so that reliable isolation of the connection between the contact sections 13, 13' and the assigned current bar pieces 14, 15 is ensured.

Figure 5:
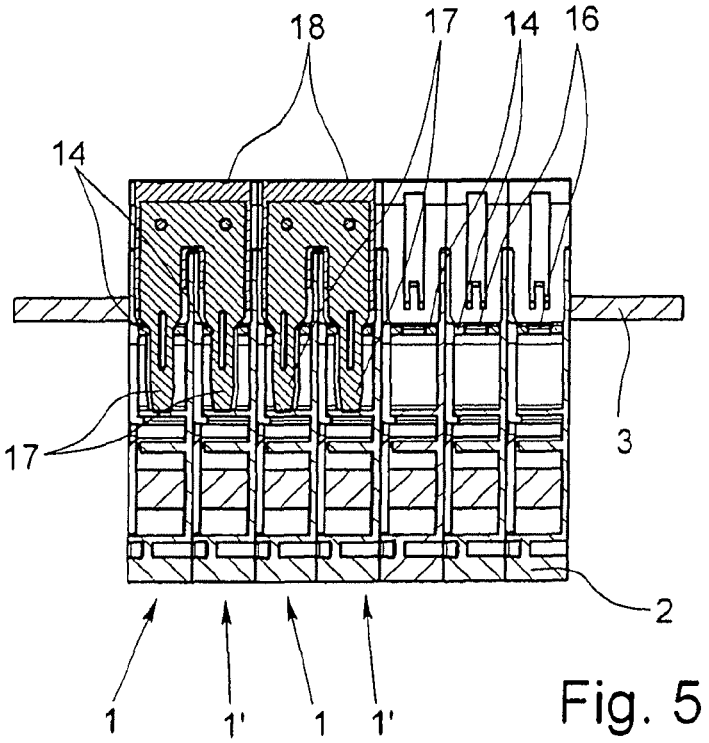
FIG. 5 is a sectional view through the modular terminal block as shown in FIG. 4.
Figure 7:
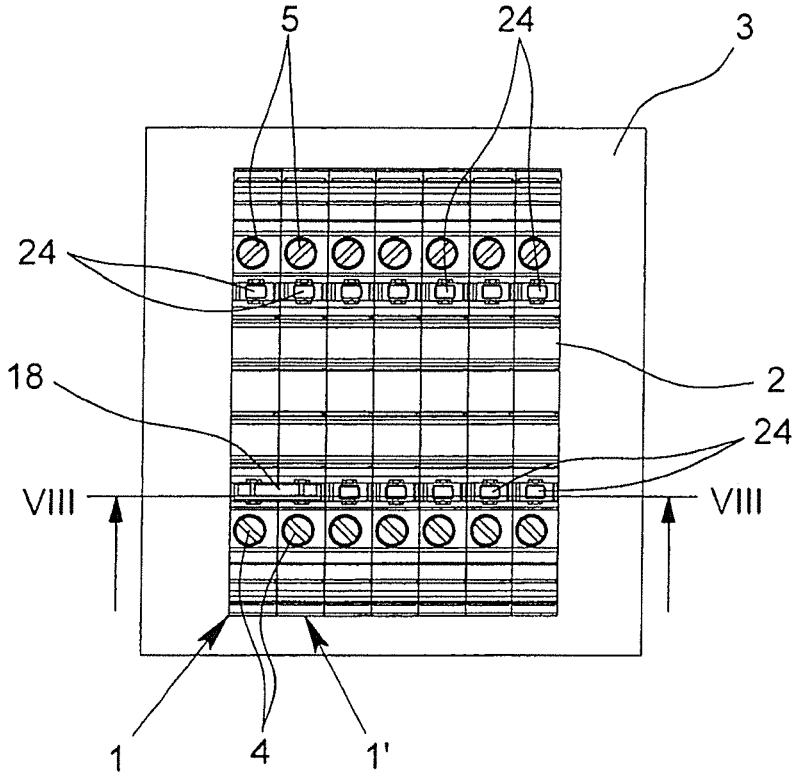
FIG. 7 is a connection side view of a modular terminal block as shown in FIG. 6.

Transverse bridging to an adjacent modular terminal 1' can be easily produced via the short current bar pieces 14, 15 located in the terminal housing 2, when each leg 17 of a respective plug-in jumper 18 is plugged into a corresponding recess 16 of two adjacent modular terminals 1, 1', which recesses are formed in the current bar pieces 14, 15, as is apparent especially from FIG. 5. The transverse bridging between two modular terminals 1, 1' which can be easily produced by plugging in a conventional plug-in jumper 18 is automatically interrupted when the plug 11 of a test plug or power plug 12 is plugged into the modular terminal 1, 1'. Plugging a plug 11 into the contact zone 10 between the first contact sections 9, 9' of two current bars 6, 7 of a modular terminal 1 leads not only to the two contact sections 9, 9', and thus, also the two current bars 6, 6' being connected to one another in an electrically conductive manner via the plug 11, but also to the second contact section 13, 13' being disengaged from the assigned current bar piece 14, 15, as is apparent from a comparison of FIGS. 9*a* and 9*b*.

Figure 3:
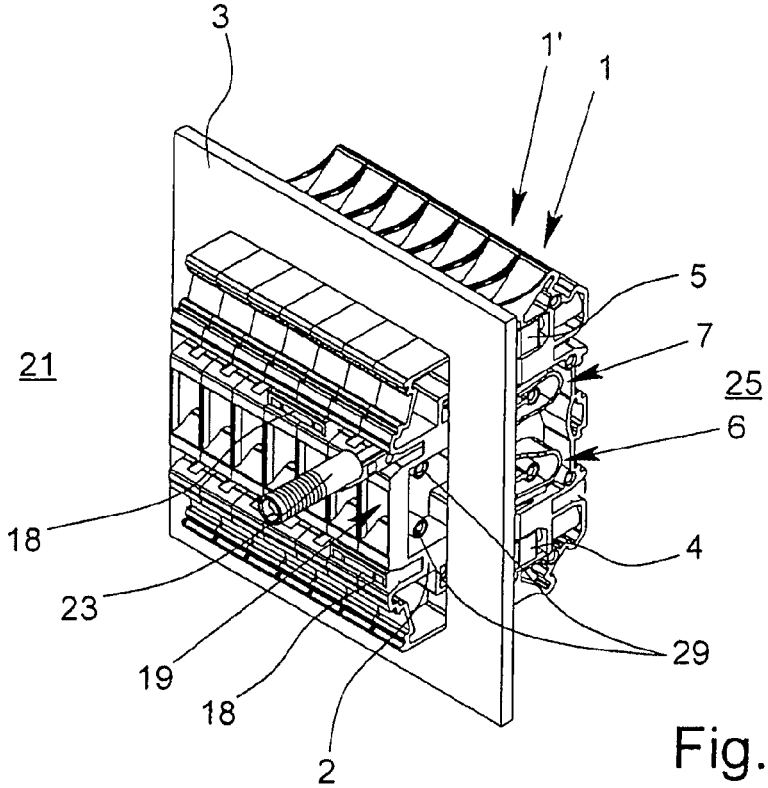
FIG. 3 is a perspective view obliquely from the operator side of a modular terminal block in accordance with the invention with a plurality of modular terminals.
Figure 6:
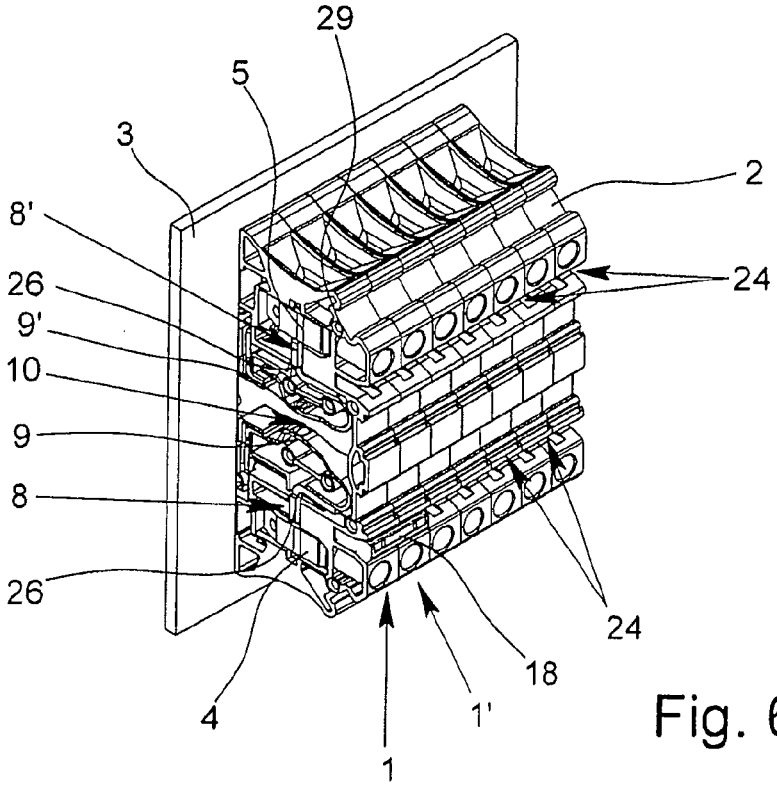
FIG. 6 is a perspective view obliquely from the connection side of the modular terminal block as shown in FIG. 3.
Figure 4:
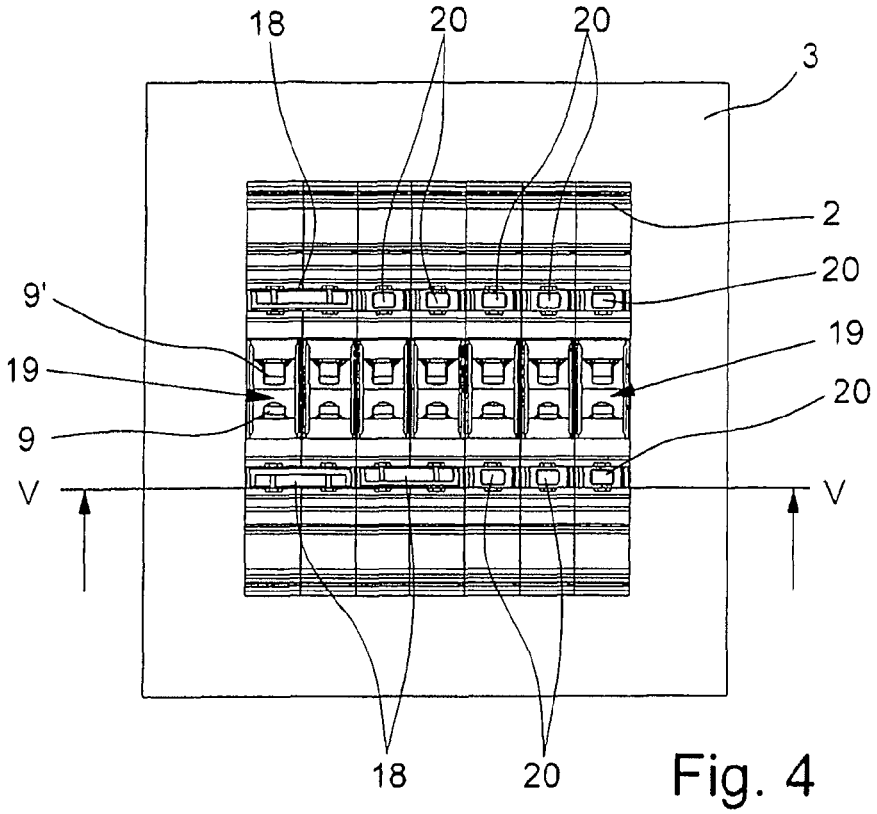
FIG. 4 shows the modular terminal block as shown in FIG. 3 from the operator side.

FIGS. 3 to 5 show that an opening 19 is made in the middle of the terminal housing 2 for plugging the plug 11 of a power plug 12 into the elastic contact zone 10 between the first contact sections 9, 9' of the two current bars 6, 7. Moreover, on either side of this opening 19, there are further openings 20 for inserting the leg 17 of a plug-in jumper 18 into the recess 16 in the current bar piece 14, 15. The openings 19, 20 are all accessible from the first side 21, i.e., the operator side, of the modular terminal 1. This yields the advantage that, in an arrangement of the modular terminals 1 or a corresponding modular terminal block in an opening in the wall 3 of a switchgear cabinet, both a test plug and power plug 12 as well as a plug-in jumper 18 can be plugged into the modular terminals 1, 1' without the switchgear cabinet door having to be opened.

Figure 8:
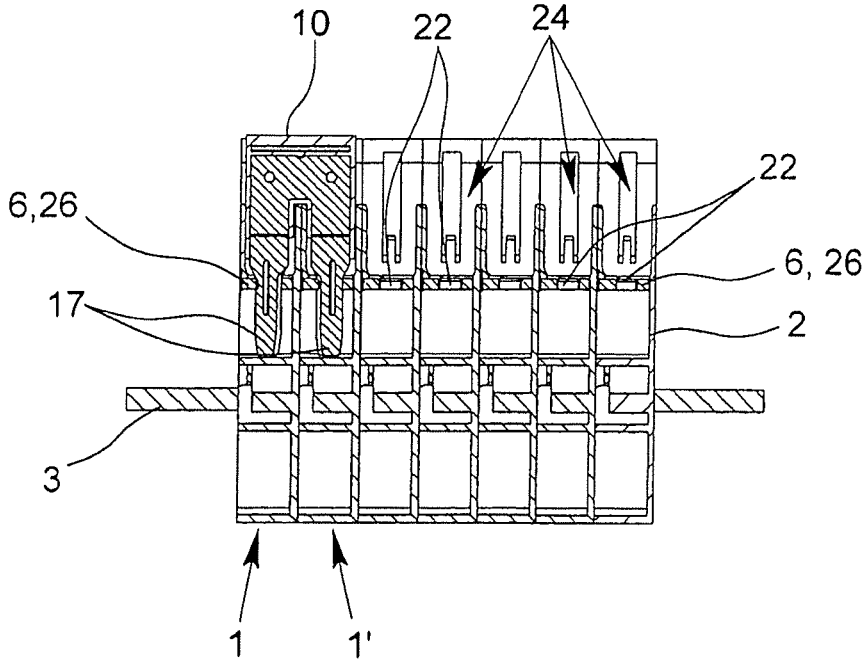
FIG. 8 shows a section through the test terminal block according to FIG. 7.
Figure 9A:
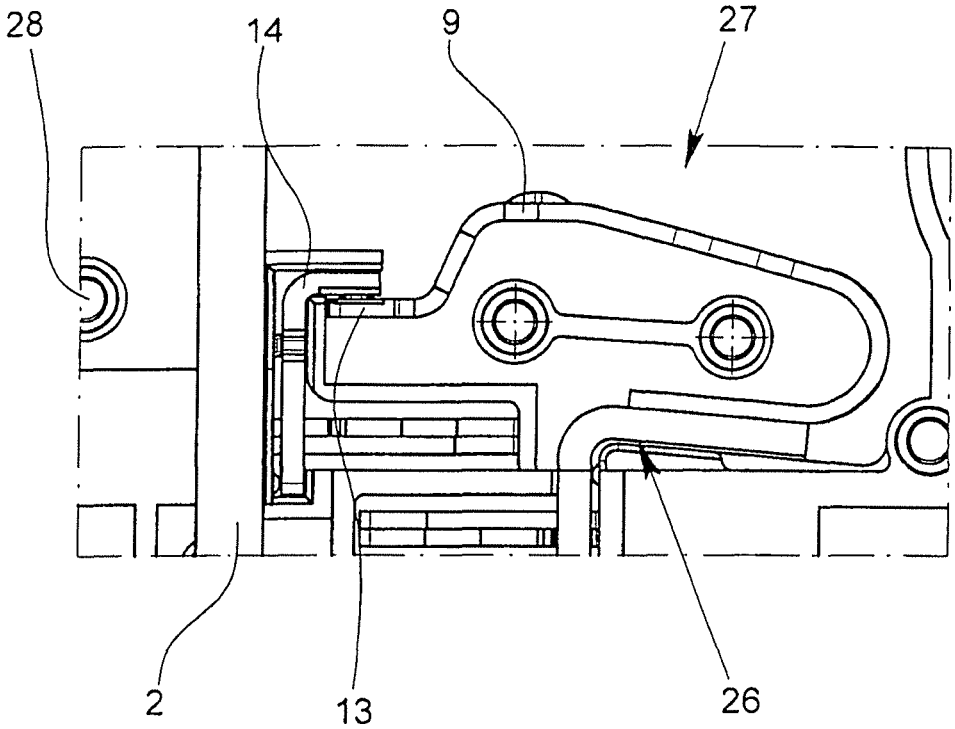
FIG. 9 shows two enlargements of a detail of the modular terminal as shown in FIGS. 1 & 2.
Figure 9B:
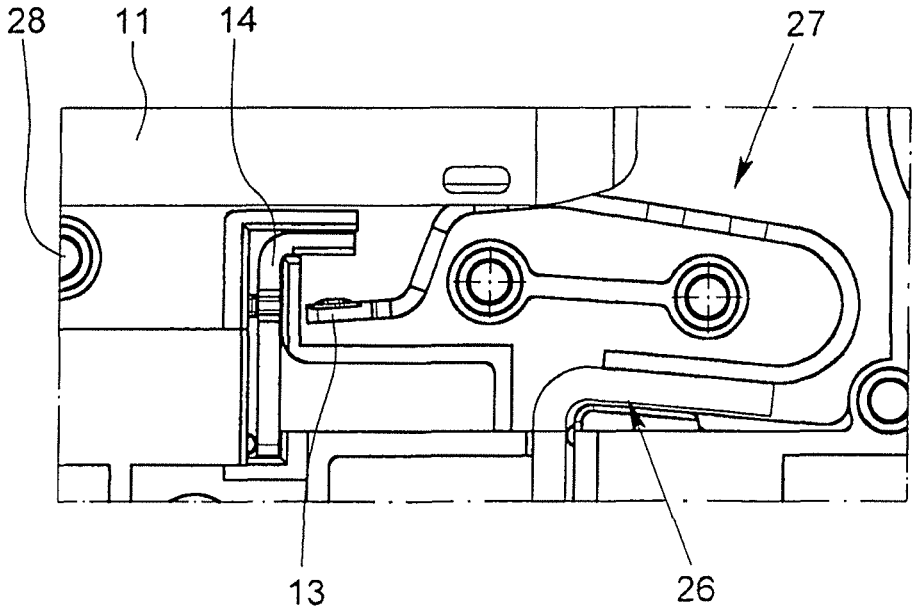

FIG. 8 shows that each of the current bars 6, 7 have a recess 22 in the area of their connector sections 8, 8' for inserting a leg 17 of a plug-in jumper 18 or of a test plug 23. For this purpose, corresponding openings 24 are made in the terminal housing 2 that are accessible from the second side 25, i.e., the connector side of the modular terminal 1. The recesses 16 in the current bar pieces 14, 15 and the recesses 22 in the current bars 6, 7 are made such that they are suitable for accommodating conventional plug-in jumpers 18 or test plugs 23 or test adapters. FIG. 3 shows that, alternatively, plug-in jumpers 18 or test plugs 23 can be plugged into the recesses 16 or the openings 20 of individual modular terminals 1.

In the exemplary embodiment of the electrical modular terminal 1 shown in the figures, the two current bars 6, 7 each consist of two individual elongated metal strips 26, 27 which are soldered, welded or riveted to one another in the transition region. The two connector sections 8, 8' are formed by a first angled metal strip 26, while the first contact section 9, 9' and the second contact section 13, 13' are both made on the second metal strip 27. While the first metal strip 26 is relatively rigid, the second metal strip 27 is made as a contact spring which ensures the spring force which is required for the first contact section 9, 9' and the second contact section 13, 13'. By using different materials for the two metal strips 26, 27 and especially by the two metal strips 26, 27 having different cross sections, the two metal strips 26, 27 have different spring properties so that the current bars 6, 7 can be optimally matched to the different requirements in the connector section 8, 8', on the one hand, and in the contact zones on the other hand.

The modular terminal block shown in FIGS. 3 to 8 is formed of a plurality of interconnected modular terminals 1 of which, if necessary, two or even more adjacent modular terminals 1, 1' are connected to one another in an electrically conductive manner via a plug-in jumper 18 when a plug 11 has not been plugged in the two modular terminals 1, 1'. The individual modular terminals 1, 1' are latched to one another, for which several latch pins 28 are provided on one side of the terminal housing 2 and corresponding latch recesses 29 are formed on the opposite side of the terminal housing 2.

Figure 10:
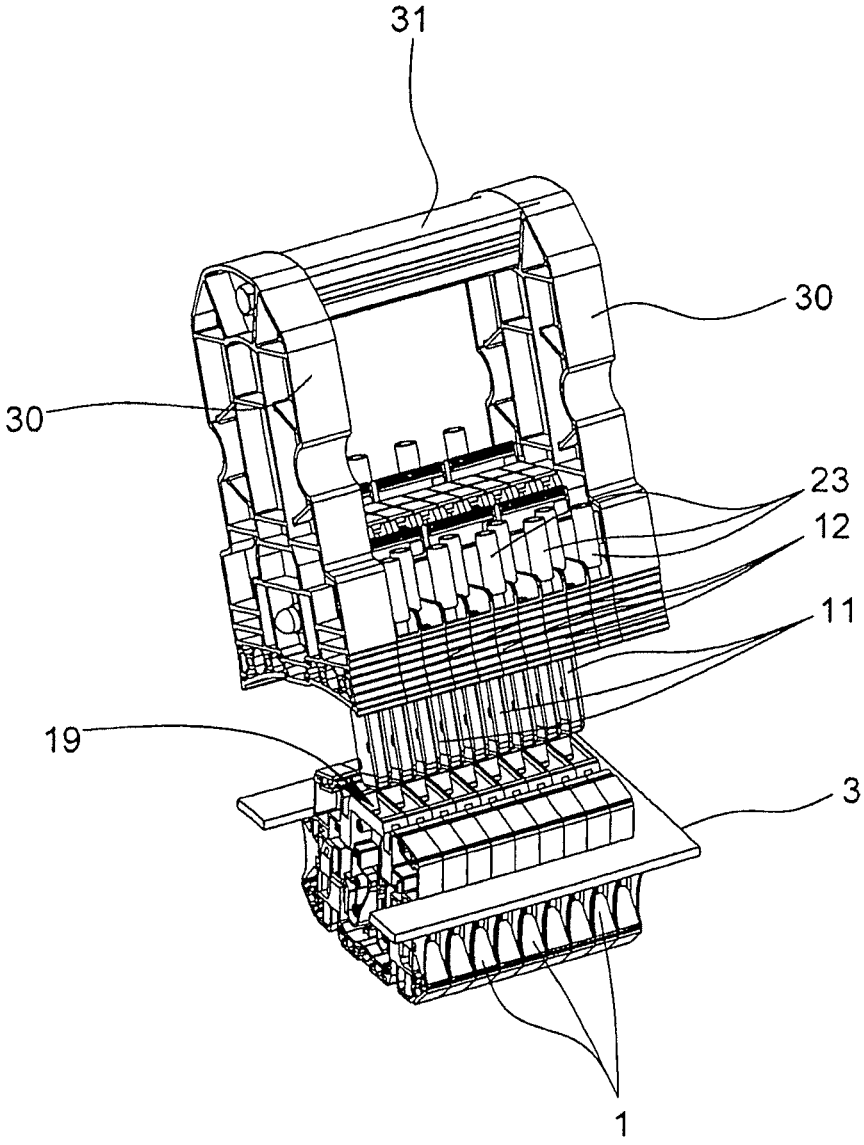
FIG. 10 shows a test isolating block comprise of a modular terminal block in accordance with the invention and a power plug block, in the not yet mated state.

FIG. 10 shows a test isolation block comprising a plurality of modular terminals 1 which are connected to one another into a modular terminal block and a corresponding number of power plugs 12 which have been mated to form a power plug block, the power plug block not yet having been plugged into the modular terminal block. On either side of the power plug block there, there are two fastening elements 30 that are connected to one another via a handle 31 for easy handling of the power plug block composed of the individual power plugs 12. In order to prevent faulty insertion of the power plug block into the modular terminal block, there is a polarization between the power plug block and the modular terminal block and between the individual power plugs and the individual modular terminals.

What is claimed is:

1. An electrical modular terminal, comprising:

a terminal housing, at least two conductor connector elements which are located in the, terminal housing, and at least two current bars, the current bars each having a connector section and a first contact section, the connector sections being assigned to a respective one of said at least two conductor connector elements, and the first contact sections together forming an elastic contact zone for accommodating a plug of a power plug, the first contact sections being spaced apart from one another and only being connected to one another in an electrically conductive manner via the plug with the plug inserted, wherein each of the current bars have a second contact section, wherein two current bar pieces are provided in the terminal housing, wherein at least one recess is formed in at least one of the current bar pieces for inserting one leg of a plug-in jumper, wherein a respective current bar piece is assigned to each current bar such that the second contact section of the respective current bar is connected in an electrically conductive manner to the assigned current bar piece when the plug is not plugged in, and the second contact section of the respective current bar is spaced apart from the assigned current bar piece when the plug has been plugged in.

2. The electrical modular terminal as claimed in claim 1, wherein each first contact section is located between the connector section and the second contact section of the respective current bar.

3. The electrical modular terminal as claimed in claim 2, wherein an opening is provided in the terminal housing for inserting the plug of a power plug into the elastic contact zone and at least one opening is provided for inserting a leg of a plug-in jumper into the recess in the respective current bar piece, the openings being accessible from a first, operator side.

4. The electrical modular terminal as claimed in claim 2, wherein each of the current bars has at least one recess for inserting at least one of a plug and a leg of a plug-in jumper, and wherein corresponding openings are provided in the terminal housing that are accessible from a connector side of the housing.

5. The electrical modular terminal as claimed in claim 1, wherein the each of the current bars is comprised of two individual elongated metal strips which are connected to one another in an electrically conductive manner, each of the connector sections being formed by a first metal strip and each of the first contact section and the second contact section being formed by a second metal strip.

6. The electrical modular terminal as claimed in claim 5, wherein metal strips of which the current bars are formed are each made of a different material.

7. The electrical modular terminal as claimed in claim 6, wherein the materials of the metal strips of different material differ with respect to each other as to at least one of the stiffness, spring properties, and cross section thereof.

8. A modular terminal block comprising:

at least two electrical modular terminals which are located next to one another, each of the modular terminals comprising:

a terminal housing, at least two conductor connector elements which are located in the, terminal housing, and at least two current bars, the current bars each having a connector section and a first contact section, the connector sections being assigned to a respective one of said at least two conductor connector elements, and the first contact sections together forming an elastic contact zone for accommodating a plug of a power plug, the first contact sections being spaced apart from one another and only being connected to one another in an electrically conductive manner via the plug with the plug inserted, wherein each of the current bars have a second contact section, wherein two current bar pieces are provided in the terminal housing, wherein at least one recess is formed in at least one of the current bar pieces for inserting one leg of a plug-in jumper, wherein a respective current bar piece is assigned to each current bar such that the second contact section of the respective current bar is connected in an electrically conductive manner to the assigned current bar piece when the plug is not plugged in, and the second contact section of the respective current bar is spaced apart from the assigned current bar piece when the plug has been plugged in; and at least one plug-in jumper which has at least two legs, wherein:

one leg of a respective plug-in jumper is plugged into at least one current bar piece of a first of the at least two electrical modular terminals and into a corresponding current bar piece of a second of the at least two electrical modular terminals so that two conductor connector elements of the electrical modular terminals which are located next to one another are connected to one another in an electrically conductive manner when a plug of a power plug has not been inserted in the two modular terminals.

9. The modular terminal block as claimed in claim 8, wherein a mechanical connection is provided in the terminal housing, for connecting the modular terminals to one another.

10. The modular terminal block as claimed in claim 9, wherein the mechanical connection comprises a latch pin which is located on one side of the terminal housing and corresponding latch recesses formed at another side of the terminal housing.

11. The modular terminal block as claimed in claim 9, wherein a plug of a power plug is plugged into a contact zone of respective individual modular terminals so that the first contact sections of the modular terminals are each connected to one another in an electrically conductive manner via the plug which has been plugged into the respective modular terminal.

* * * * *